United States Patent [19]

Capone

[11] Patent Number: 4,717,071

[45] Date of Patent: Jan. 5, 1988

[54] COMBUSTION TRIM CONTROL APPARATUS

[75] Inventor: David M. Capone, Oakmont, Pa.

[73] Assignee: Ametek, Inc., New York, N.Y.

[21] Appl. No.: 874,583

[22] Filed: Jun. 16, 1986

[51] Int. Cl.[4] ..... F23N 5/00

[52] U.S. Cl. ..... 236/15 E; 74/479; 431/12

[58] Field of Search ..... 236/15 E, 15 B, 15 D; 431/12, 76; 74/479

[56] References Cited

U.S. PATENT DOCUMENTS

| | | | |
|---|---|---|---|
| 1,690,329 | 11/1928 | Baxter . | |
| 1,849,162 | 3/1932 | Wilhjelm et al. . | |
| 2,122,683 | 7/1938 | Faverty | 158/53 |
| 2,290,770 | 7/1942 | Schumann | 230/111 |
| 3,549,089 | 12/1970 | Hamlett | 236/15 |
| 4,157,238 | 6/1979 | Van Berkum | 431/12 |
| 4,249,886 | 2/1981 | Bush | 431/90 |
| 4,264,297 | 4/1981 | Van Berkum | 431/76 |
| 4,474,549 | 10/1984 | Capone | 431/12 |
| 4,509,912 | 4/1985 | Van Berkum | 431/76 |
| 4,649,767 | 3/1987 | Banas | 431/76 X |

FOREIGN PATENT DOCUMENTS

| | | | |
|---|---|---|---|
| 742375 | 12/1955 | United Kingdom | 431/12 |

*Primary Examiner*—William E. Wayner

*Attorney, Agent, or Firm*—Buell, Ziesenheim, Back & Alstadt

[57] ABSTRACT

A modification of a basic jack-shaft control apparatus for a combustion system to provide a trim control. A first radial arm is mounted on a first rotating shaft which controls a fuel valve and a second radial arm is mounted on a second rotating shaft which controls an air damper. Ordinarily, a linking rod connects the radially outward ends of said first and second radial arms. The trim modification comprises attaching one end of a third radial arm to the radially outward end of either said first radial arm or said second radial arm. A third rotating shaft is attached to the third radial arm where it is attached to said first or second radial arm. The third radial arm rotates under the influence of trim control motor means on a plane transverse to the plane of rotation of the arm on which it is mounted. The linking rod connects the radially outward end of the third radial arm with the radially outward end of either said first or second radial arm to which the third radial arm is not otherwise attached.

12 Claims, 10 Drawing Figures

COMBUSTION TRIM CONTROL APPARATUS

Figure 1:
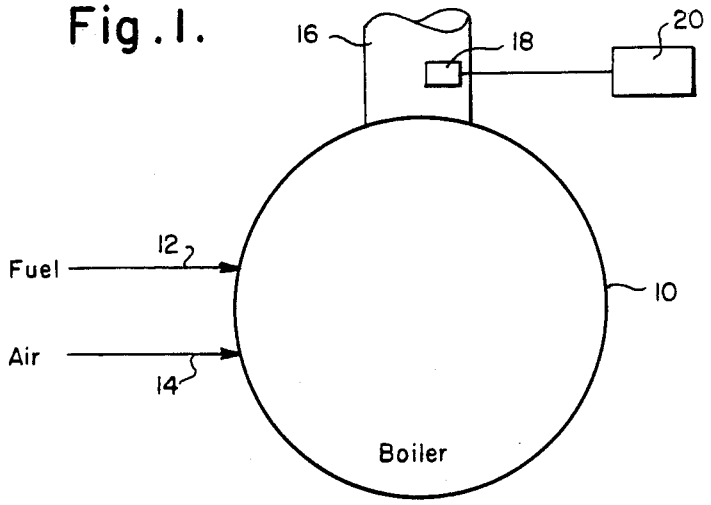

This invention relates to a combustion trim control apparatus and more particularly to an actuator for automatically adjusting the ratio of air-to-fuel flow to a combustion system such as a boiler.

It is known to mechanically connect the rotating shafts controlling fuel feed and air or oxygen intake in a combustion system to establish a definite and selectable air-to-fuel or oxygen-to-fuel ratio for the combustion system. The simplest combustion control system is known as a jack-shaft system.

It is common practice to operate boilers with 15 to 35 percent more air than is actually required for combustion. However, the amount of excess air must be carefully controlled since excess air flow reduces flame temperature and carries usable heat out of the process. In order to attain optimum fuel economy in the operation of a boiler, the air/fuel ratio should be continuously adjusted or trimmed to correct for changes in fuel heat values, oil viscosity, gas density, variations in air temperature and humidity, burner condition, fuel temperature changes, fuel pressure changes, linkage wear, and other factors. Measurement and control of the amount of excess air is one means for achieving optimum fuel economy. The amount of excess air can be detected by measuring the oxygen content in the stack containing the flue gases from the combustion zone.

This invention relates to a modification of a basic jack-shaft apparatus for controlling combustion in a boiler. In the basic apparatus, a sensor, such as a temperature sensor, detects changes in boiler-load input and responds through a first controller which adjusts the fuel flow to the boiler. By means of the jack-shaft system, air flow is increased or decreased in a fixed ratio corresponding to increases or decreases in fuel flow. The present invention provides a trim control to a jack-shaft actuator to respond to changes in a combustion system other than changes in boiler-load, such as changes in the fuel and air characteristics. The sensor for the trim controller can be an oxygen sensor located in the boiler stack to measure the amount of excess air. The trim controller, based upon air changes in the combustion system detected by the oxygen sensor, either lessens, amplifies or holds constant the ratio of fuel to air flow otherwise made available to the combustion system through the jack-shaft actuator. This is accomplished by utilizing the trim mechanism to lessen, amplify or hold constant the ratio of lengths of certain members in the jack-shaft apparatus, as described below.

This invention relates to a combustion trim control apparatus for supplying a combustion system with fuel and an oxygen-containing gas comprising first rotatable shaft means actuated by first control motor means for regulating the rate of fuel flow to the system; second rotatable shaft means for regulating the rate of oxygen-containing gas flow to the system; first radial arm means having a radially inward portion mounted on said first rotatable shaft means for rotating therewith and a radially outward portion; second radial arm means having a radial inward portion mounted on said second rotatable means for rotating therewith and a radially outward portion; third radial arm means having a radially inward portion mounted on said radially outward portion of said first radial arm means and having a radially outward portion; third rotatable shaft means connected with said radially inward portion of said third radial arm means having second control motor means for rotating said third radial arm means; said third radial arm means rotatable with said first radial arm means and also independently rotatable about said outward portion of said first radial arm means; and linking means having flexure means at opposite ends thereof connecting said outward portion of said third radial arm means with said outward portion of said second radial arm means.

In the above structure, the third radial arm means constitutes the trim control mechanism and is mounted on the outward portion of the first radial arm means. The third radial arm means can similarly be mounted on the outward portion of the second radial arm means.

Figure 2:
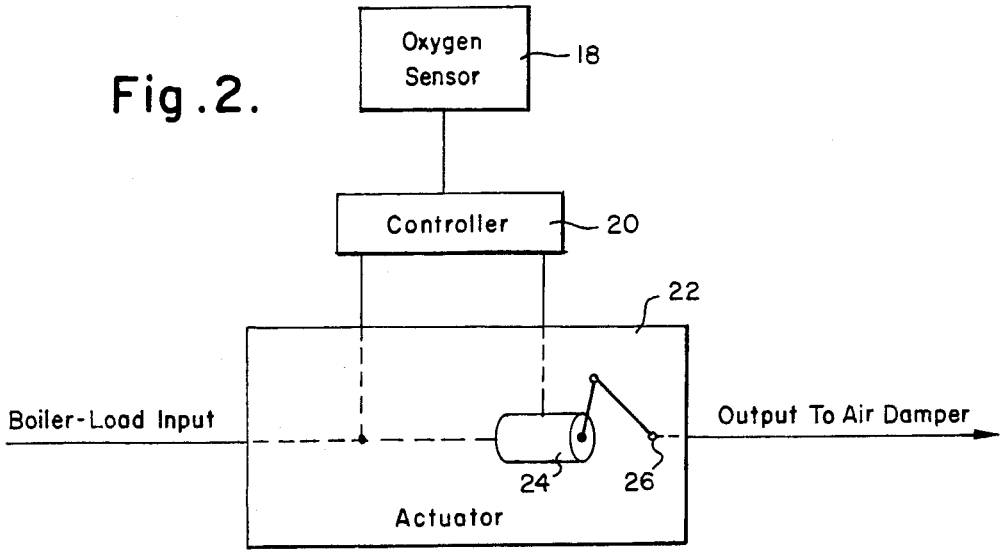
Figure 3:
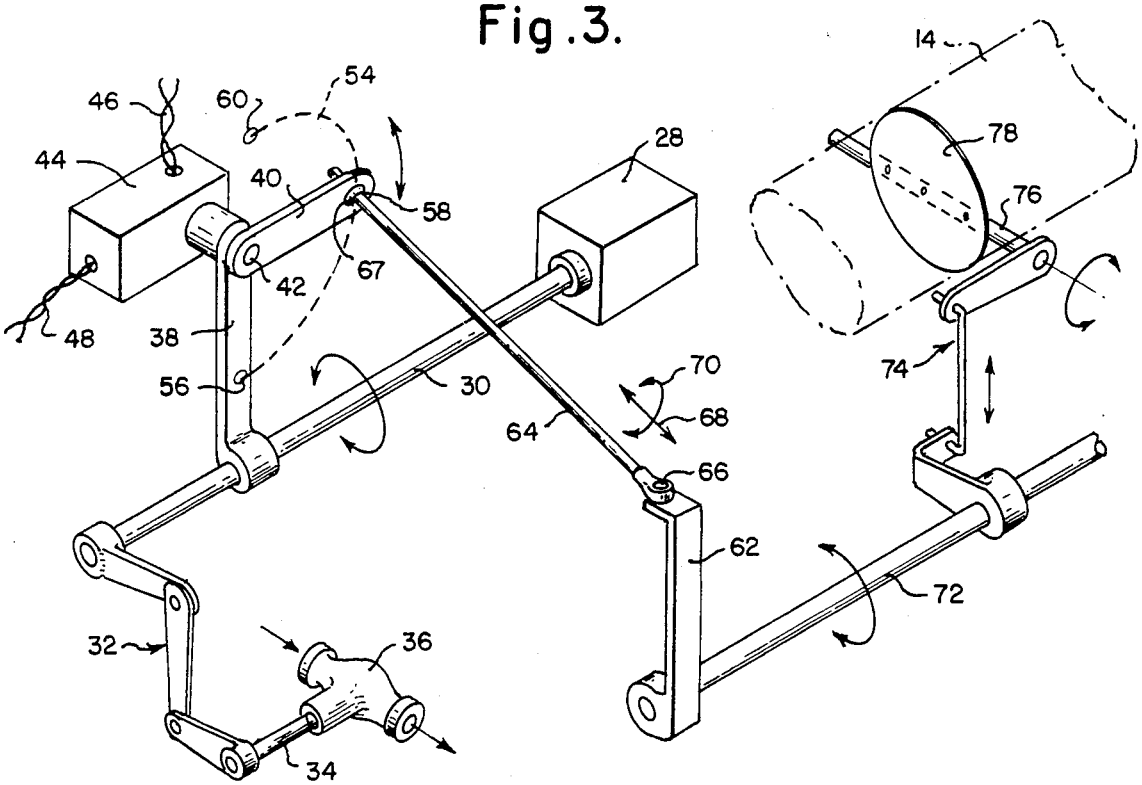
Figure 4:
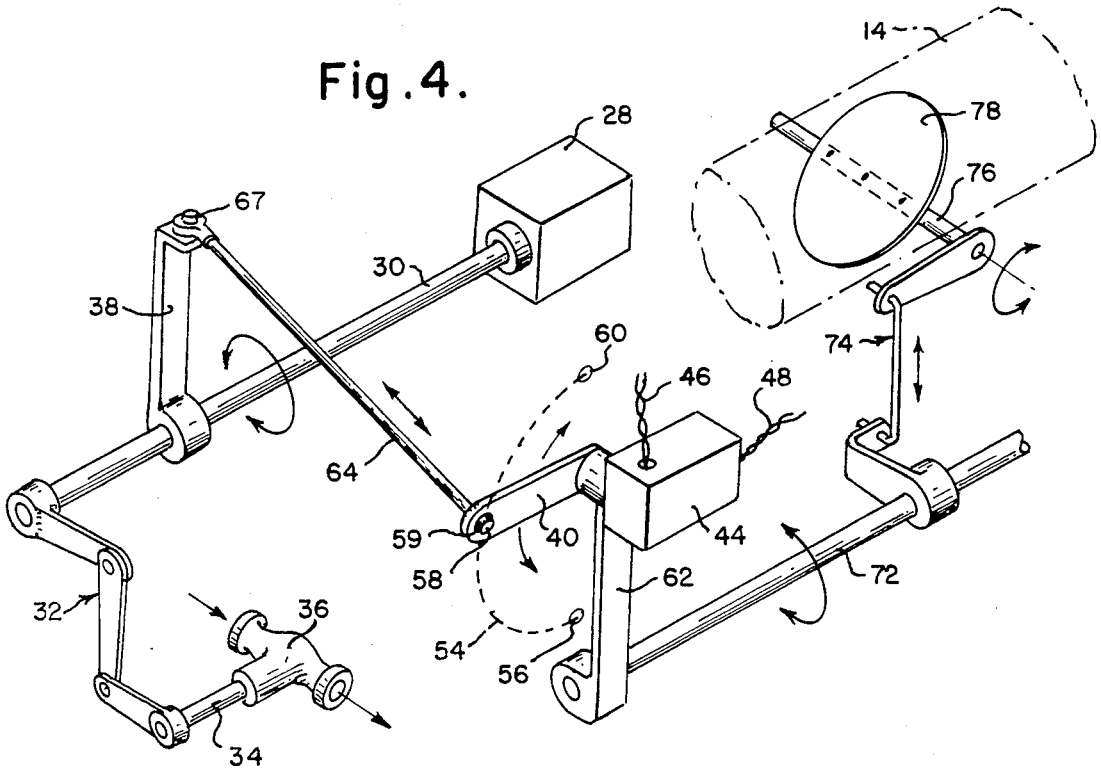
Figure 5:
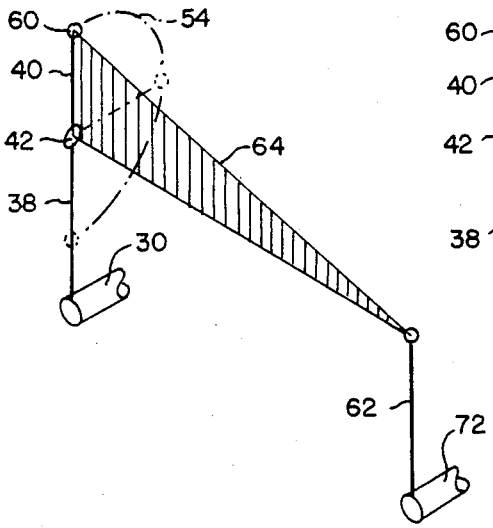
Figure 6:
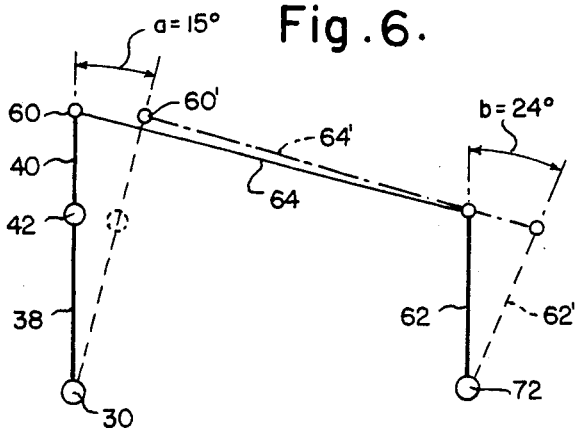
Figure 7:
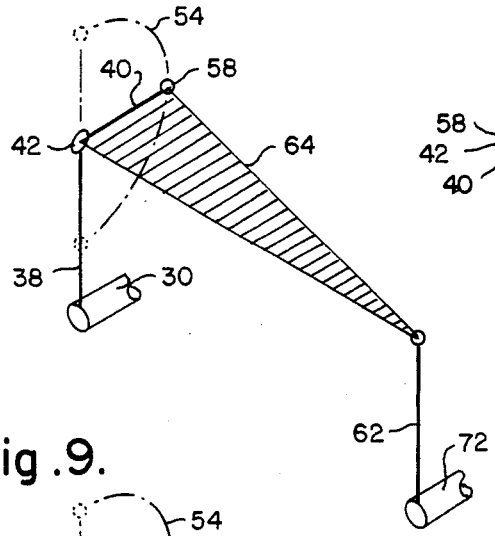
Figure 8:
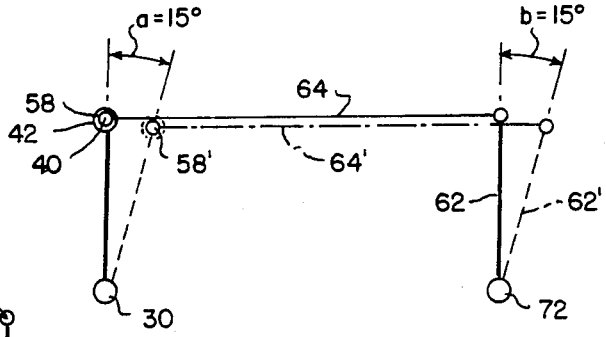
Figure 9:
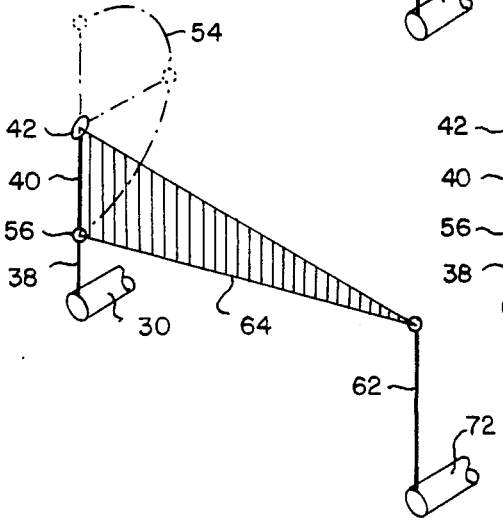
Figure 10:
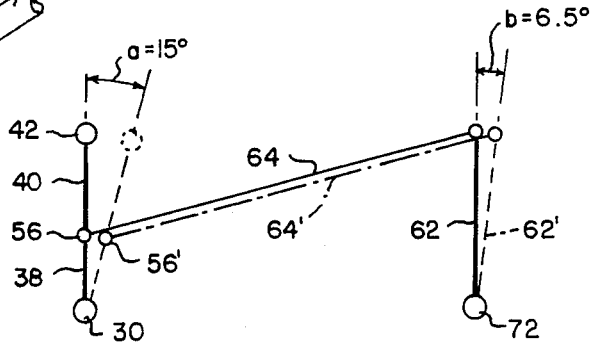

This invention will be more clearly understood by reference to the attached figures in which FIG. 1 is a schematic diagram of a boiler combustion system having an oxygen sensor, FIG. 2 is a schematic view of an oxygen sensor in cooperative arrangement with a trim controller of this invention, FIG. 3 is an isometric view of one mode of the trim acutator of the invention, FIG. 4 is an isometric view of another mode of the trim actuator of the invention, FIGS. 5 and 6 diagrammatically illustrate the trim actuator in an amplification mode, FIGS. 7 and 8 diagrammatically illustrate the trim actuator in a hold constant mode, and FIGS. 9 and 10 diagrammatically illustrate the trim actuator in a lessening mode.

FIG. 1 shows boiler 10 to which fuel oil is introduced through line 12 and combustion air or oxygen is introduced through line 14 and from which combustion gases containing excess oxygen is removed through stack 16. An oxygen sensor 18 is located in stack 16 to continuously monitor the level or percentage of excess oxygen in the gases flowing through stack 16. The oxygen measurement is transmitted to trim controller 20.

FIG. 2 shows oxygen sensor 18 and trim controller 20 in association with actuator 22 of this invention. Actuator 22 is comprised of two primary components 24 and 26. Actuator component 24 receives a boiler-load input signal, such as a boiler steam temperature or pressure measurement, and modifies the response to this signal by a signal from trim controller 20. The resultant is transmitted to actuator component 26 which regulates a damper in air inlet conduit 14.

FIGS. 3 and 4 provide illustrations of different modes of actuator 22. Referring first to FIG. 3, a jack-shaft containing the improved trim control mechanism of this invention is shown. The jack-shaft system includes stationary control motor 28 which rotates shaft 30 a portion of one revolution in either direction in response to boiler fuel oil requirements, as indicated by steam temperature or pressure measurements. Rotation of shaft 30 is transferred through linkage system 32 to rotating valve stem 34 which controls the gate opening in flow valve 36 through which oil flows to a boiler combustion chamber.

Radial arm 38 is fixedly mounted at its radially inward end on rotatable shaft 30. Radial trim control arm 40 is rotatably mounted on the radially outward terminus of arm 38 remote from shaft 30. Radial trim control arm 40 is mounted at its radially inward end on rotating shaft 42, which is rotated by trim control motor 44. Trim control motor 44, shaft 42 and arm 40 are all floatably mounted on the radial outward end of arm 38 so that they are all free to move together with arm 38. Motor 44 receives a signal from controller 20 through transmission lines 46 and also receives electric power through transmission lines 48.

Trim control motor 44 rotates the radially outward portion of trim control arm 40 through a semicircular arc 54, which has a low point 56, an intermediate point 58 and a high point 60. It is shown below that points 56, 58 and 60 impart relatively low, medium and high rotational movements to damper control arm 62, which is connected to trim control arm 40 through linkage rod 64. Linkage rod 64 is provided with a first universal joint 66 near one end and a second universal joint 67 near the other end to provide flexure to these ends enabling linkage 64 to move in both a lineal direction as indicated by arrows 68 in response to primary control motor 28 and a rotary direction as indicated by arrows 70 in response to trim control motor 44.

The motion imparted by linkage rod 64 results in rotational movement of the outward portion of radial damper arm 62 which is fixedly mounted on rotating shaft 72 so as to rotate shaft 72. The rotation of shaft 72 actuates linkage system 74 which in turn rotates support brace 76 for damper gate 78 in air conduit 14 to relatively open and close damper 78 and admit more or less air to the combustion chamber of boiler 10.

Another mode of actuator 22 is illustrated in FIG. 4, which is related to FIG. 3 in that like parts have the same numerical designations. In the mode of FIG. 4, the trim mechanism is mounted on radial air damper arm 62 rather than arm 38, as in FIG. 3. Otherwise, the systems of FIGS. 2 and 3 are similar to each other and operate in a similar manner.

The function of the trim control system of FIG. 3 is illustrated in FIGS. 5 through 10. FIGS. 5 through 10 are schematic illustrations of FIG. 3 in various operational modes. FIGS. 5 and 6 illustrate the function of the trim control system when trim control arm 40 is at high point 60 as indicated in FIG. 3. FIGS. 7 and 8 illustrate the function of the trim control system when it is at the intermediate point 58, shown in FIG. 3. FIGS. 9 and 10 illustrate the function of the trim control system when it is at the low point 56, shown in FIG. 3.

FIGS. 5, 7 and 9 schematically show the device of FIG. 3 with the linkage rod 64 as the hypotenuse of a shaded right triangle. The three positions of linkage rod 64 are achieved by rotation of the radially outer portion of trim control arm 40 on rotating shaft 42 along a semicircular arc 54 to the positions 60, 58, and 56, shown in FIGS. 5, 7 and 9, respectively. When linkage rod 64 is held in each of these three positions, the movement translated to damper control arm 62 upon a given amount of rotating of oil valve control shaft 30 is illustrated by reference to FIGS. 6, 8 and 10, respectively.

FIGS. 6, 8 and 10 each show the effect of rotation of oil control shaft 30 through an angle (a) of 15 degrees upon the resultant angle (b) of rotation of air damper control shaft 72. FIG. 6 shows that when rotating arm 40 is at its high point 60, rotation of oil valve control shaft 30 an angular distance of 15 degrees brings the left-most end of linkage rod 64 from point 60 to point 60' so that the linkage rod position is represented by 64' and in turn rotates damper control arm 62 to position 62', causing a resultant rotation of damper control shaft 72 through an angle (b) of 24 degrees. Therefore, when the trim mechanism is in its high position, there is more than a one-for-one movement in air damper control shaft 72 as a result of a given movement in oil valve control shaft 30.

FIG. 8 shows that when rotative arm 40 is at its intermediate or normal position at point 58, rotation of oil valve control shaft 30 an angular distance (a) of 15 degrees brings the left-most end of linkage rod 64 from point 58 to point 58' so that the linkage rod position is represented by 64', and the rod rotates damper control arm 62 to position 62', causing a resultant rotation of damper control shaft 72 through an angle (b) of 15 degrees. Therefore, when the trim mechanism is at its intermediate position it does not exert any effect in the system and there is a one-for-one movement in oil valve control shaft 30 and air damper control shaft 72.

FIG. 10 shows that when rotating arm 40 is at its low position at point 56, rotation of oil valve control shaft 30 an angular distance (a) of 15 degrees brings the left most end of linkage rod 64 from point 56 to point 56' so that the linkage rod position is represented by 64' and the rod rotates damper control arm 62 to position 62', causing a resultant rotation of damper control shaft 72 through an angle (b) of 6.5 degrees. Therefore, when the trim mechanism is at its low position there is less than a one-for-one movement in air damper control shaft 72 as a result of a given movement in oil valve control shaft 30.

FIGS. 6, 8 and 10 show that the trim control mechanism of this invention is adapted to magnify, equalize or diminish movement of air damper 78 for a given movement of the gate of oil control valve 36.

Although the radially outward portion of trim control arm 40 is shown sweeping through a semicircle, it could also be adapted to sweep through only a portion of a semicircle or it could be adapted to sweep through an arc greater than a semicircle, including a full circle. In any case, linkage rod 64 would be represented as the hypotenuse of a right triangle so that linkage rod 64 would always remain the same length. The movement to the various positions is accommodated by providing flexure means such as universal joints 66 and 67, at each end of linkage rod 64.

I claim:

1. A trim control apparatus for regulating fuel and oxygen-containing gas flow to a combustion system comprising:

first rotatable shaft means for regulating the rate of fuel flow to said system;

second rotatable shaft means for regulating the rate of oxygen-containing gas flow to said system;

first radial arm means having a radially inward portion mounted on said first rotatable shaft means for rotating therewith and a radially outward portion;

second radial arm means having a radially inward portion mounted on said second rotatable shaft means for rotating therewith and a radially outward portion;

third radial arm means having a radially inward portion mounted on said radially outward portion of said first radial arm means and having a radially outward portion;

third rotatable shaft means connected with said radially inward portion of said third radial arm means for rotating said third radial arm means;

said third radial arm means rotatable with said first radial arm means and also independently rotatable about said outward portion of said first radial arm means; and linking means connecting said outward portion of said third radial arm means with said outward portion of said second radial arm means.

2. The apparatus of claim 1 including first control motor means for rotating said first rotatable shaft means.

3. The apparatus of claim 1 including second control motor means for rotating said third rotatable shaft means.

4. The apparatus of claim 3 wherein said second control motor means is responsive to oxygen sensor means.

5. The apparatus of claim 1 including flexure means at the opposite ends of said linking means.

6. A trim control apparatus for regulating fuel and oxygen-containing gas flow to a combustion system comprising:

first rotatable shaft means for regulating the rate of fuel flow to said system;

second rotatable shaft means for regulating the rate of oxygen-containing gas flow to said system;

first radial arm means having a radially inward portion mounted on said first rotatable shaft means for rotating therewith and a radially outward portion;

second radial arm means having a radially inward portion mounted on said second rotatable shaft means for rotating therewith and a radially outward portion;

third radial arm means having a radially inward portion mounted on said radially outward portion of said second radial arm means and having a radially outward portion;

third rotatable shaft means connected with said radially inward portion of said third radial arm means for rotating said third radial arm means;

said third radial arm means rotatable with said second radial arm means and also independently rotatable about said outward portion of said second radial arm means; and linking means connecting said outward portion of said third radial arm means with said outward portion of said first radial arm means.

7. The apparatus of claim 6 including first control motor means for rotating said first rotatable shaft means.

8. The apparatus of claim 6 including second control motor means for rotating said third rotatable shaft means.

9. The appartus of claim 6 wherein said second control motor means is responsive to oxygen sensor means.

10. The apparatus of claim 6 including flexure means at the opposite ends of said linking means.

11. A trim control apparatus for regulating fuel and oxygen-containing gas flow to a combustion system comprising:

first rotatable shaft means for regulating the rate of fuel flow to said system;

first control motor means for rotating said first rotatable shaft means;

second rotatable shaft means for regulating the rate of oxygen-containing gas flow to said system;

first radial arm means having a radially inward portion mounted on said first rotatable shaft means for rotating therewith and a radially outward portion;

second radial arm means having a radially inward portion mounted on said second rotatable shaft means for rotating therewith and a radially outward portion;

third radial arm means having a radially inward portion mounted on said radially outward portion of said first radial arm means and having a radially outward portion;

third rotatable shaft means connected with said radially inward portion of said third radial arm means for rotating said third radial arm means;

said third radial arm means rotatable with said first radial arm means and also independently rotatable about said outward portion of said first radial arm means;

second control motor means for rotating said third rotatable shaft means; and linking means connecting said outward portion of said third radial arm means with said outward portion of said second radial arm means.

12. A trim control apparatus for regulating fuel and oxygen-containing gas flow to a combustion system comprising:

first rotatable shaft means for regulating the rate of fuel flow to said system;

first control motor means for rotating said first rotatable shaft means;

second rotatable shaft means for regulating the rate of oxygen-containing gas flow to said system;

first radial arm means having a radially inward portion mounted on said first rotatable shaft means for rotating therewith and a radially outward portion;

second radial arm means having a radially inward portion mounted on said second rotatable shaft means for rotating therewith and a radially outward portion;

third radial arm means having a radially inward portion mounted on said radially outward portion of said second radial arm means and having a radially outward portion;

third rotatable shaft means connected with said radially inward portion of said third radial arm means for rotating said third radial arm means;

said third radial arm means rotatable with said second radial arm means and also independently rotatable about said outward portion of said second radial arm means;

second control motor means for rotating said third rotatable shaft means; and linking means connecting said outward portion of said third radial arm means with said outward portion of said first radial arm means.

* * * * *